US011076738B2

(12) United States Patent
Scimone et al.

(10) Patent No.: US 11,076,738 B2
(45) Date of Patent: Aug. 3, 2021

(54) CUTTING DEVICE

(71) Applicant: Slice, Inc., San Jose, CA (US)

(72) Inventors: Thomas Scimone, Campbell, CA (US); Scot Herbst, Santa Cruz, CA (US); Robert Joseph Gallegos, Fremont, CA (US)

(73) Assignee: Slice, Inc., Sunny Isles, FL (US)

( * ) Notice: Subject to any disclaimer, the term of this patent is extended or adjusted under 35 U.S.C. 154(b) by 0 days.

(21) Appl. No.: 16/565,677

(22) Filed: Sep. 10, 2019

(65) Prior Publication Data

US 2020/0107691 A1 Apr. 9, 2020

Related U.S. Application Data

(63) Continuation-in-part of application No. 16/155,240, filed on Oct. 9, 2018.

(51) Int. Cl.
*A47L 13/08* (2006.01)

(52) U.S. Cl.
CPC ..... *A47L 13/08* (2013.01)

(58) Field of Classification Search
CPC ..... A47L 13/08; B26B 5/001–003
See application file for complete search history.

(56) References Cited

U.S. PATENT DOCUMENTS 2,715,770 A * 8/1955 Meyer ..... B44D 3/162 30/330
5,025,558 A * 6/1991 Gilbert ..... B26B 5/001 30/125
6,553,674 B1 * 4/2003 Budrow ..... B26B 5/001 30/125
6,941,661 B2 * 9/2005 Frazer ..... B26B 1/048 30/160
8,220,161 B2 * 7/2012 Chang ..... B26B 5/001 30/162
2005/0132576 A1 * 6/2005 Onion ..... B26B 1/02 30/158
2013/0091712 A1 * 4/2013 Schekalla ..... B26B 5/003
2014/0290070 A1 * 10/2014 Landwehr ..... B26B 1/08 30/169
2016/0167239 A1 * 6/2016 Gallegos ..... B26B 5/003 30/162
2018/0250837 A1 * 9/2018 Dias Baptista ..... B26B 5/003

* cited by examiner

*Primary Examiner* — Ghassem Alie
*Assistant Examiner* — Fernando A Ayala
(74) *Attorney, Agent, or Firm* — Ellenoff Grossman & Schole LLP; James M. Smedley; Alex Korona

(57) ABSTRACT

A cutting device is disclosed. The cutting device has a housing, a cutting assembly that is movably disposed in the housing, the cutting assembly including a body member, an actuating member, and a first urging member that is configured to urge the actuating member away from the body member, from an inner position toward an outer position relative to the body member, by applying a first urging force, and a second urging member that is configured to urge the cutting assembly to retract within the housing by applying a second urging force that urges the actuating member to move from an extended position toward a retracted position relative to the housing. The housing includes at least one recess.

15 Claims, 6 Drawing Sheets

CUTTING DEVICE

RELATED APPLICATIONS

This application claims the benefit of U.S. Nonprovisional patent application Ser. No. 16/155,240 filed on Oct. 9, 2018, which is hereby incorporated by reference in its entirety.

TECHNICAL FIELD

The present disclosure generally relates to a cutting device, and more particularly to a cutting device having one or more replaceable blades.

BACKGROUND

A scraper is a basic cutting tool that may be provided in a variety of forms. A scraper may be used in many applications such as removing undesired material from a surface, smoothing or levelling a surface, or preparing a surface for a desired use or further treatment.

The most common technique for locking a scraper blade in an extended position is to manually lock the blade. This is typically achieved by including one or more locking features that hold the blade extended from the housing during use and then retract safely into the scraper housing for storage. However, it is recognized that a scraper with auto-retract functionality may be beneficial as a safety improvement as it allows the blade to be exposed and extended from the housing in use, and then auto-retracts while not in use (e.g., when still held or stored in a pocket, pouch, or other storage means) to avoid unintentional damage and injury from the blade.

The problem with conventional auto-retract configurations is that when force is applied against the edge of the blade in the direction of the main longitudinal axis of the housing, the operational digit of a user (thumb or finger) typically applies a variable load or force against a slider in order to keep the blade extended from the housing. For someone skilled in the art of scraping, whether it be removing paint, labels, glues and adhesives, it is understood that the force required to scrape effectively produces a non-constant, non-uniform force. The application of constant, non-uniform/non-constant force to a slider by a user to keep the scraper extended quickly produces fatigue or discomfort to the user's finger or thumb.

The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a housing, a cutting assembly that is movably disposed in the housing, the cutting assembly including a body member, an actuating member, and a first urging member that is configured to urge the actuating member away from the body member, from an inner position toward an outer position relative to the body member, by applying a first urging force, and a second urging member that is configured to urge the cutting assembly to retract within the housing by applying a second urging force that urges the actuating member to move from an extended position toward a retracted position relative to the housing. The housing includes at least one recess. The actuating member includes at least one protrusion that is selectively receivable in the at least one recess when the actuating member is in both the extended position relative to the housing and the inner position relative to the body member.

In another aspect, the present disclosure is directed to a method. The method includes movably disposing a cutting assembly in a housing, the cutting assembly including an actuating member and a body member, urging the actuating member away from the body member, from an inner position toward an outer position relative to the body member, by applying a first urging force, urging the cutting assembly to retract within the housing by applying a second urging force that urges the actuating member to move from an extended position toward a retracted position relative to the housing, and applying a moving force that is greater than the second urging force to move the actuating member to the extended position relative to the housing. The method also includes, when the actuating member is in the extended position relative to the housing, applying an inward force that is greater than the first urging force to move the actuating member to the inner position relative to the body member. The method further includes, when the actuating member is in both the extended position relative to the housing and the inner position relative to the body member, removing the moving force while maintaining the inward force and using a portion of the housing to block movement of the actuating member toward the retracted position relative to the housing.

DETAILED DESCRIPTION AND INDUSTRIAL APPLICABILITY

FIGS. 1-7 illustrate an exemplary cutting device 105. The exemplary cutting device disclosed herein may be any suitable device for cutting material. For example, the exemplary disclosed device and method may be used in any application involving cutting material such as scraping material. For example, the exemplary cutting device and method may be used in applications such as removing undesired material from a surface, smoothing or levelling a surface, preparing a surface for a desired use or further treatment, and/or any other suitable application for scraping material. Cutting device 105 may for example be any suitable type of scraper. Cutting device 105 may be a mini scraper. For example, cutting device 105 may be a mini scraper that is easily stored, carried, or transported.

Cutting device 105 may include a housing assembly 110 and a cutting assembly 115. Cutting assembly 115 may be movably disposed in housing assembly 110. The exemplary cutting device may be constructed from any suitable variety of durable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, housing assembly 110 may be formed partially or substantially entirely from plastic, plastic composite, metal, and/or metal alloy materials. For example, housing assembly 110 may be formed from plastic or metal structural members. Cutting assembly 115 may include components formed from plastic, plastic composite, metal, and/or metal alloy materials and components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic. For example, cutting device 105 may include any suitable materials for use in a cutting device such as, e.g., a scraper.

Figure 8:
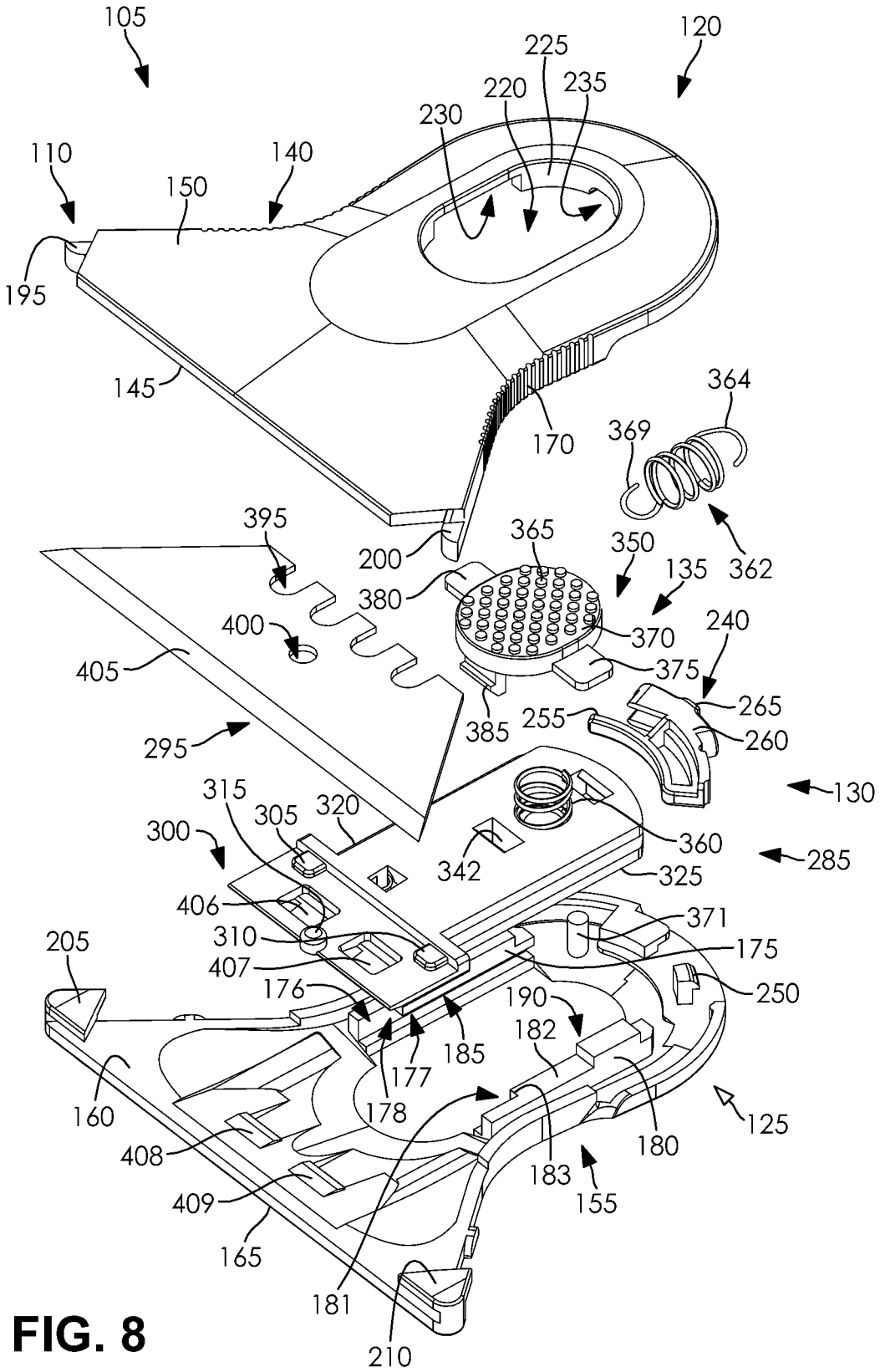
FIG. 8 is an exploded view of an exemplary cutting device in accordance with an embodiment of the present invention.

As illustrated in FIG. 8, housing assembly 110 may include a first housing member 120, a second housing member 125, and a locking assembly 130. Cutting assembly 115 may be received in a cavity formed by first housing member 120 and second housing member 125. Locking assembly 130 may selectively unlock and lock first housing member 120 and second housing member 125 together.

Housing members 120 and 125 may be, for example, corresponding halves of housing assembly 110 that may be attached together to form housing assembly 110. For example, first housing member 120 may be a top member such as, for example, a top-half body shell, and second housing member 125 may be a bottom member such as, for example, a bottom-half body shell. Housing members 120 and 125 may be configured to house or contain (e.g., separately or working together to house or contain) other components of cutting device 105.

Housing assembly 110 may provide, for example, a gripping surface for cutting device 105 for use by a user. For example, housing members 120 and 125 may be attached together to form a substantially hollow housing having a cavity 135 configured to receive and retain other portions of housing assembly 110 and cutting assembly 115. For example, housing assembly 110 may be a substantially flat housing having any desired polygonal shape. For example, housing assembly 110 may have an elliptical shape with a flared or widened end portion (e.g., front end portion). Also for example, housing assembly 110 may include portions having any desired shape such as, for example, a tube shape, a square prism, triangular prism, a hexagonal prism, an octagonal prism, a polygonal prism, and/or any other desired shape.

Figure 9:
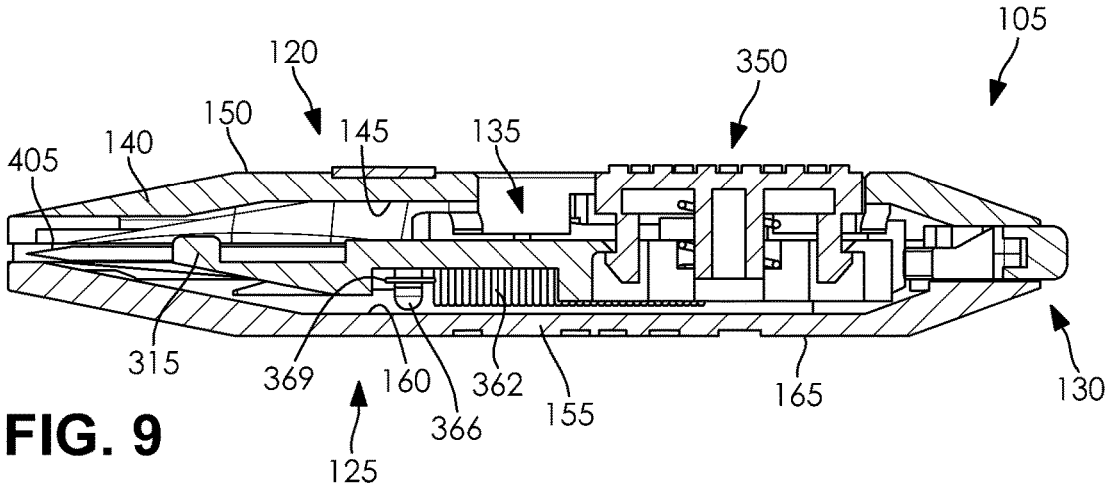
FIG. 9 is a sectional view of an exemplary cutting device in accordance with an embodiment of the present invention.
Figure 10:
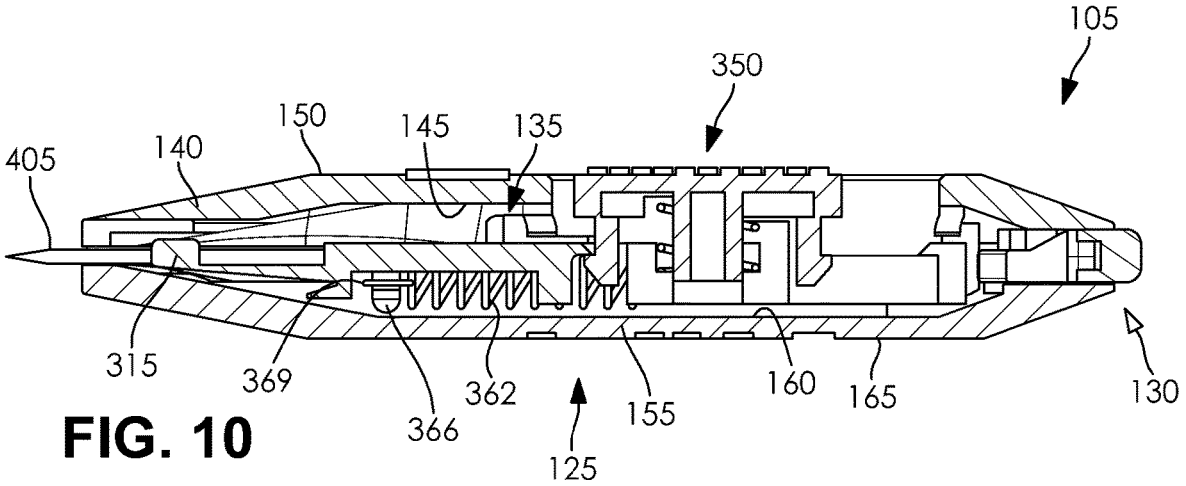
FIG. 10 is a sectional view of an exemplary cutting device in accordance with an embodiment of the present invention.

As illustrated in FIGS. 8-10, first housing member 120 may include a wall portion 140 that may form a portion (e.g., upper portion or half) of cavity 135. Wall portion 140 may include an interior surface 145 facing cavity 135 and an exterior surface 150 that users may grip while holding cutting device 105. Second housing member 125 may include a wall portion 155 that may form a portion (e.g., lower portion or half) of cavity 135. Wall portion 155 may include an interior surface 160 facing cavity 135 and an exterior surface 165 that users may grip while holding cutting device 105. Wall portion 140 may also include protrusions 170 disposed at any desired portion of exterior surface 150 that may assist a user in gripping cutting device 105 (e.g., during scraping). Wall portion 155 may include similar protrusions disposed at any desired portion of exterior surface 165. Wall portions 140 and 155 (e.g., interior surfaces 145 and 160) forming cavity 135 may be shaped, dimensioned, and/or formed to retain other components of housing assembly 110 (e.g., locking assembly 130) and portions of cutting assembly 115. Wall portions 140 and 155 may include recesses, apertures, cavities, protrusions, and/or any other suitable portions disposed at respective interior surfaces 145 and 160 that receive corresponding recesses, apertures, cavities, protrusions, and/or any other suitable portions of housing assembly 110 (e.g., locking assembly 130) and portions of cutting assembly 115. For example, second housing member 125 may include a plurality of protruding portions 175 and 180 including respective recesses 185 and 190 that may be configured to receive portions of cutting assembly 115. Recesses 185 and 190 may be for example elongated recesses that provide tracks allowing for a predetermined movement of cutting assembly 115 within housing assembly 110. For example, recesses 185 and 190 may be substantially straight recesses (e.g., grooves) that receive portions of cutting assembly 115 to allow for a substantially straight movement of cutting assembly 115 as it moves within cavity 135 of housing assembly 110. First housing member 120 may for example include similar protrusions and recesses as an alternative to, or in addition to, recesses 185 and 190 of second housing member 125. Housing members 120 and 125 may include any other suitable recesses, apertures, cavities, protrusions, and/or any other suitable portions disposed at respective interior surfaces 145 and 160 to guide a movement of cutting assembly 115 within cavity 135 of housing assembly 110. For example, housing assembly 110 may include portions facilitating a substantially straight and/or non-rotational movement of cutting assembly 115 within cavity 135 (e.g., a straight movement in which cutting assembly 115 does not rotate).

As illustrated in FIG. 8, portion 175 may include a recess 176 and portion 180 may include a recess 181. Recesses 176 and 181 may selectively receive portions of actuating member 350 as described below.

As illustrated in FIGS. 8-10, housing members 120 and 125 may include a plurality of engagement elements to facilitate removable attachment of housing members 120 and 125. For example, first housing member 120 may include attachment portions 195 and 200 (e.g., as well as other attachment portions) and second housing member 125 may include attachment portions 205 and 210 (e.g., as well as other attachment portions) to facilitate removable attachment of housing members 120 and 125. For example, housing members 120 and 125 may include any suitable portions configured to connect and align housing members 120 and 125 during removable attachment. It is also contemplated that housing members 120 and 125 may be integrally formed with each other and may not be removably attachable.

Figure 1:
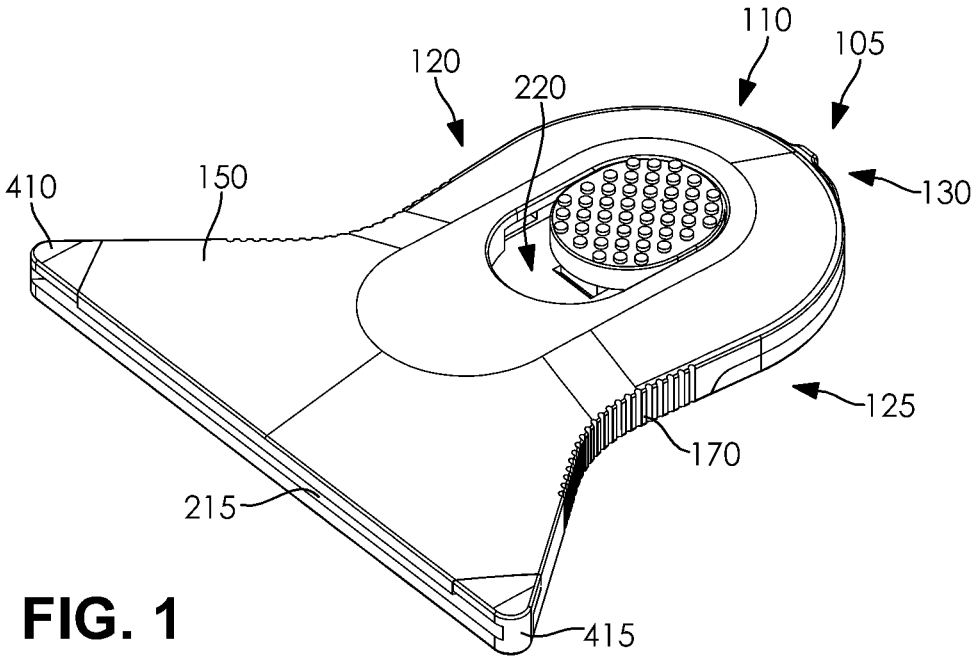
FIG. 1 is a perspective view of an exemplary cutting device in accordance with an embodiment of the present invention.
Figure 6:
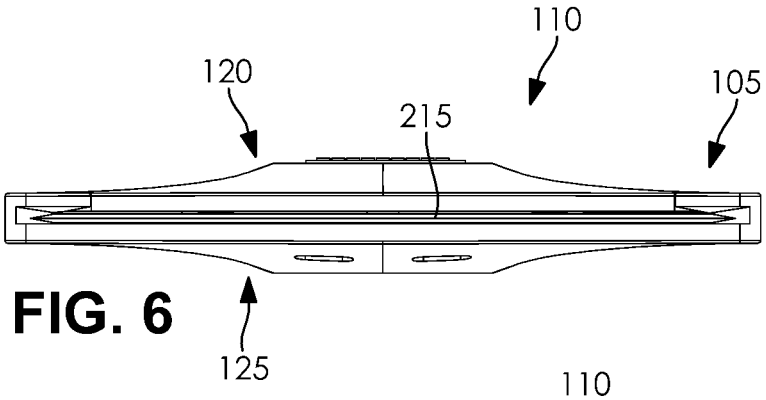
FIG. 6 is a front view of an exemplary cutting device in accordance with an embodiment of the present invention.

When attached, wall portion 140 of housing member 120 and wall portion 155 of housing member 125 may form an aperture 215 as illustrated in FIGS. 1 and 6. Aperture 215 may be located at a front portion of housing assembly 110, and may be configured to receive an exemplary cutting member of cutting assembly 115 as described below. Aperture 215 may be, for example, a blade outlet slot.

As illustrated in FIGS. 1-4 and 8, first housing member 120 (e.g., and/or second housing member 125) may include an aperture 220 formed by a portion 225 (e.g., exterior wall portion) at exterior surface 150. Aperture 220 may be configured to receive an exemplary portion of cutting assembly 115 as disclosed for example herein. Aperture 220 may include a plurality of recesses (e.g., a plurality of recesses 230 disposed at both sides of aperture 220 and one or more recesses 235 disposed at front and/or rear sides of aperture 220). As disclosed for example below, recesses 230 may selectively receive and guide a portion of cutting assembly 115 during a movement of cutting assembly 115 within cavity 135. Recesses 235 may also selectively receive portions of cutting assembly 115. Aperture 220 may be for example an elongated recess having portion 225 that may define a range of movement of the portion of cutting assembly 115 received in aperture 220, thereby helping to define a range of movement of cutting assembly 115 within cavity 135 of housing assembly 110.

Housing assembly 110 may also include any suitable attachment point to facilitate carrying and/or storage. Housing assembly 110 may also include recesses or other suitable portions for holding a weight (e.g., a metal weight or a weight formed from other relatively heavy material) to facilitate balance of cutting device 105 during use. Housing assembly 110 may further include recesses or other suitable portions for holding a magnet to facilitate storage or transport of cutting device 105. For example, cutting device 105 may include an attachment device, a weight for balancing, and/or a magnet for storage or transport.

As illustrated in FIG. 8, locking assembly 130 may include locking member 240 that may be retained in portions of housing members 120 and/or 125. Locking assembly 130 may serve to lock (e.g., selectively lock) housing members 120 and 125 together.

Locking assembly 130 may include a portion that may protrude from interior surface 145 of first housing member 120. Locking assembly 130 may also include a portion 250 that may protrude from interior surface 160 of second housing member 125. Portion 250 may be configured to receive portions of locking member 240. Locking member 240 may be removably disposable on second housing member 125 (e.g., or first housing member 120). For example, when housing members 120 and 125 are detached, locking member 240 may be movably attached to housing member 125 (e.g., to portion 250). For example, when a user detaches housing members 120 and 125, locking member 240 may remain for example attached to housing member 125. For example, a portion 255 of locking member 240 may be guided and/or retained by portion 250. Portion 255 may move relative to portion 250, thereby allowing locking member 240 for example to be movably disposed on second housing member 125. It is also contemplated that locking member 240 may alternatively remain attached to first housing member 120 when housing members 120 and 125 are detached. It is also contemplated that in an exemplary embodiment in which housing assembly 110 is an integral housing (e.g., when housing assembly 110 may be formed by a single integral housing member having housing members 120 and 125 that may be integral portions of housing assembly 110), locking member 240 may remain movably attachable to both housing members 120 and 125 of housing assembly 110 (or, e.g., may be omitted).

As illustrated in FIGS. 8-10, when housing members 120 and 125 are attached, locking member 240 may be movably disposed along a track or a guide formed by portion 250, surface 160 of housing member 125, and/or other suitable portions of housing member 125 (e.g., and/or between portions disposed on interior surface 145 of first housing member 120). For example, portions of interior surface 145 of first housing member 120 and/or portion 250 of surface 160 of second housing member 125 may be in contact with (e.g., and interconnect with) portion 255 and a portion 260 of locking member 240 so that a movement of locking member 240 is guided within housing assembly 110. For example, one or more portions of first housing member 120 and portion 250 of second housing member 125 may define a range of movement of locking member 240 within housing assembly 110. Locking member 240 may be moved to a locked position in which portion 255 of locking member 240 may engage (e.g., substantially entirely engage) with one or more portions of first housing member 120 and/or portion 250 of second housing member 125 to lock housing members 120 and 125 together. Locking member 240 may also be moved to an unlocked position in which portion 255 of locking member 240 may be disengaged from one or more portions of first housing member 120 and/or portion 250 of second housing member 125 to unlock housing members 120 and 125. Portion 255 of locking member 240 may thereby selectively engage with one or more portions of first housing member 120 and/or portion 250 of second housing member 125 (e.g., portions of locking member 240 may selectively engage with portions of housing assembly 110 to selectively lock housing assembly 110).

Figure 5:
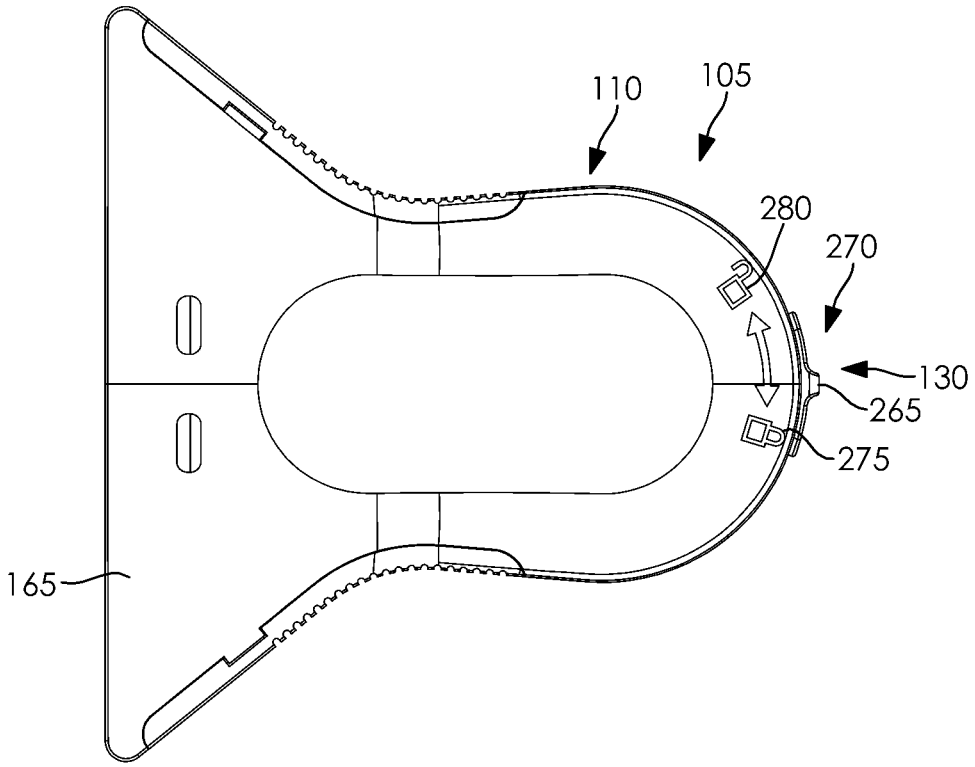
FIG. 5 is a bottom view of an exemplary cutting device in accordance with an embodiment of the present invention.
Figure 7:
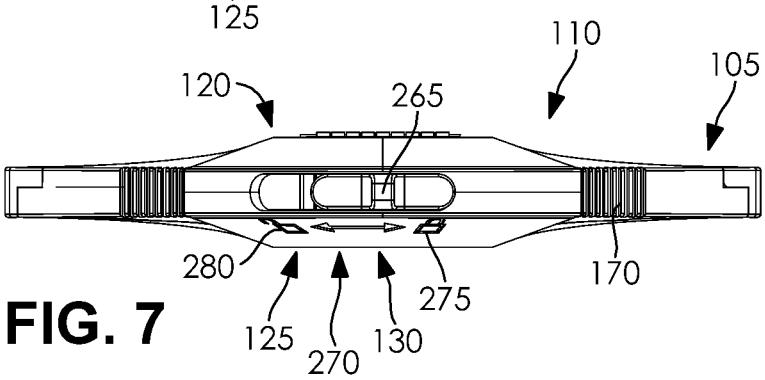
FIG. 7 is a rear view of an exemplary cutting device in accordance with an embodiment of the present invention.

As illustrated in FIGS. 5 and 7, locking member 240 of locking assembly 130 may also include a protrusion 265 disposed at an exterior surface of portion 260. Protrusion 265 may provide a point of contact for assisting a user in selectively moving locking member 240 between a locked and an unlocked position. Locking assembly 130 may also include a locking indicator 270 that may be disposed on first housing member 120 and/or second housing member 125 (e.g., or any other suitable portion of housing assembly 110). Locking indicator 270 may include a locked indicator 275 and an unlocked indicator 280 that may indicate to a user whether cutting device 105 is in a locked or an unlocked state based on a position of locking member 240 (e.g., an engagement of locking member 240 with portions of housing members 120 and 125). It is contemplated that locking assembly 130 may also include any suitable assemblies for locking housing members 120 and 125 such as, for example, a twist-lock connection, a snap connection, a screw-type connection, an adhesive connection, a hook and loop connection, or any other suitable type of (e.g., mechanical) connection.

Figure 2:
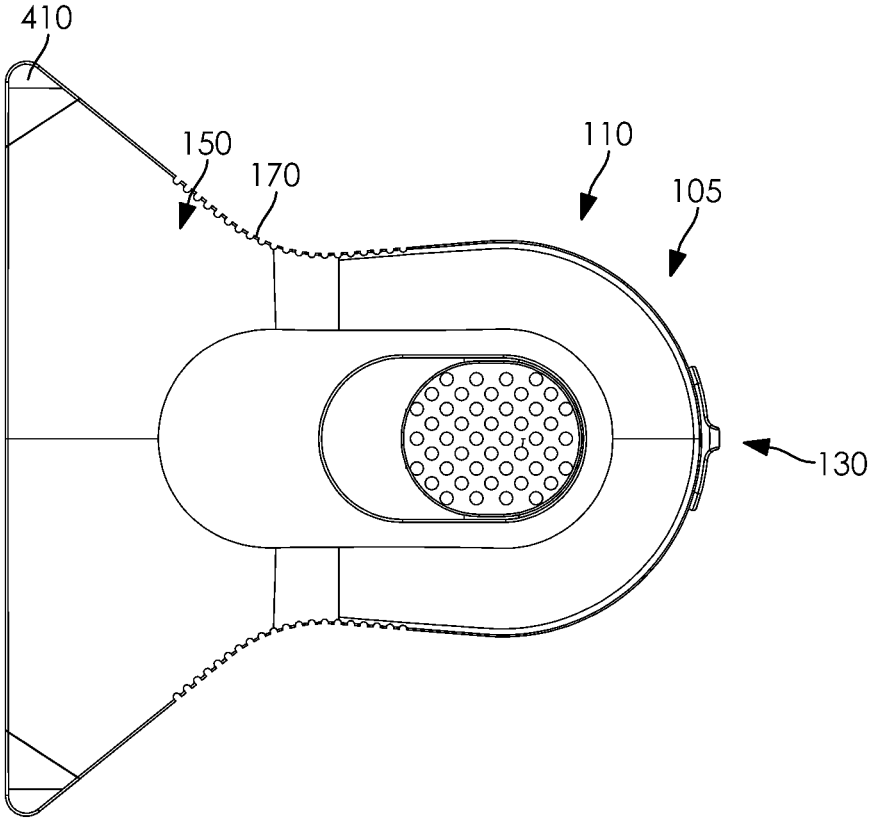
FIG. 2 is a top view of an exemplary cutting device in accordance with an embodiment of the present invention.
Figure 3:
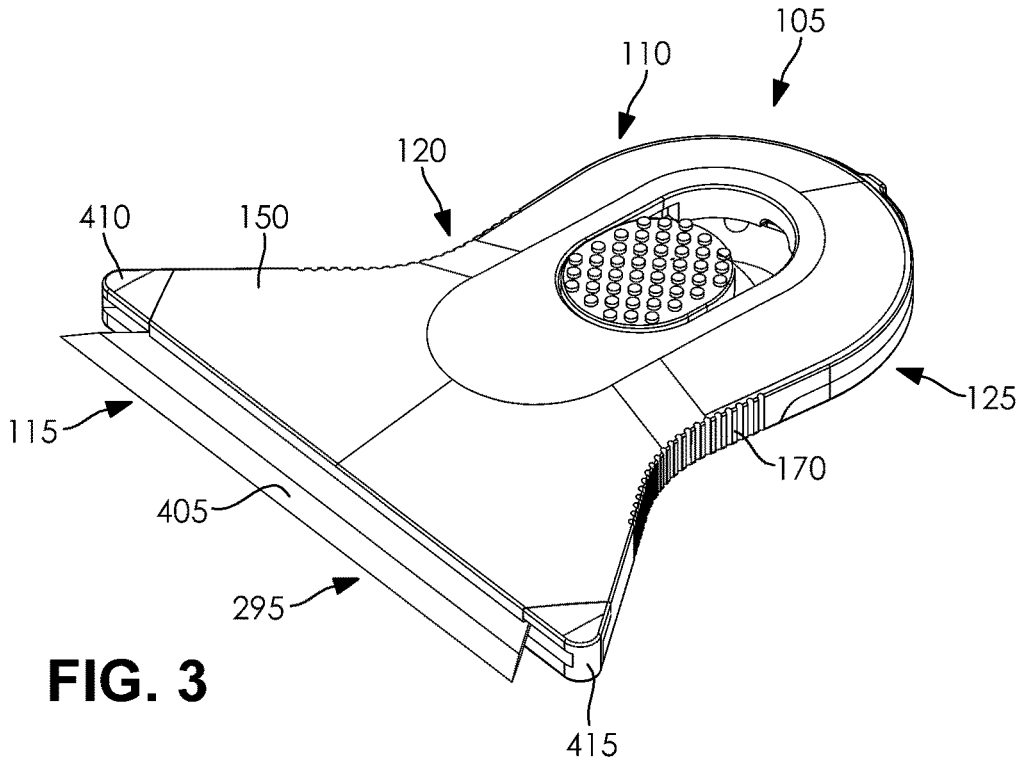
FIG. 3 is a perspective view of an exemplary cutting device in accordance with an embodiment of the present invention.
Figure 4:
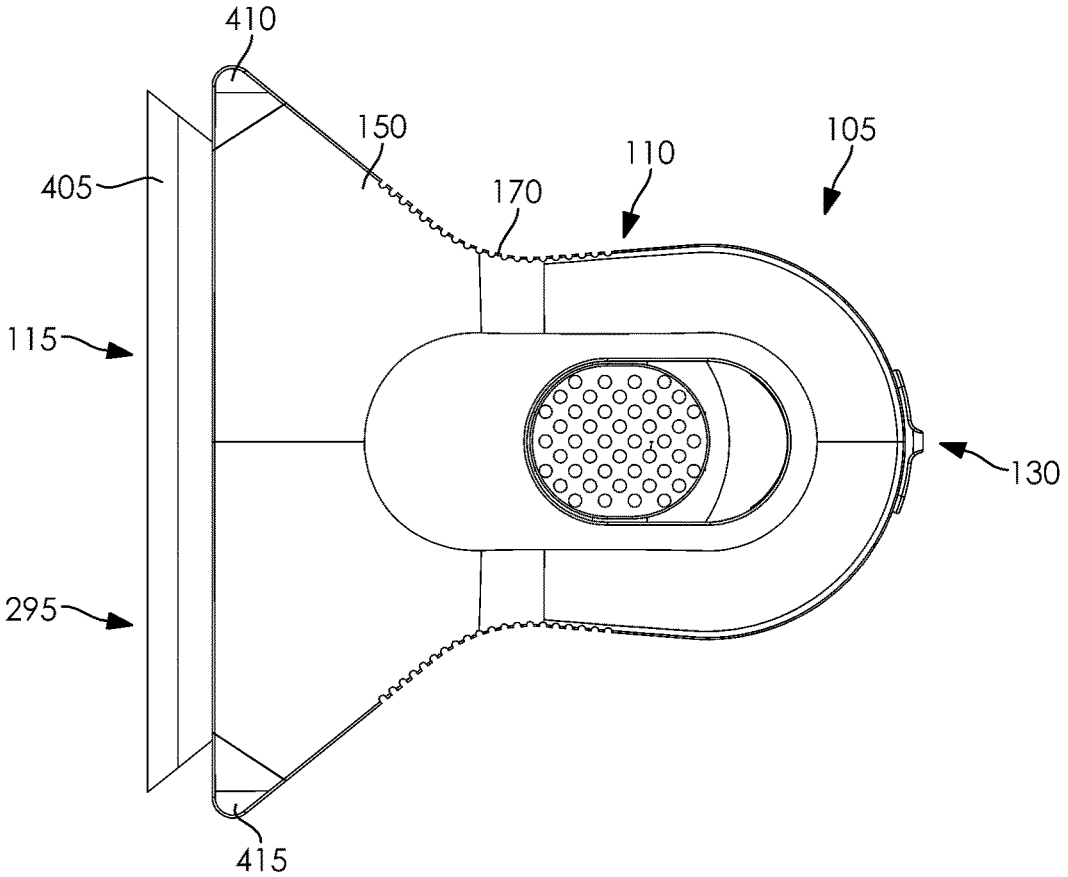
FIG. 4 is a top view of an exemplary cutting device in accordance with an embodiment of the present invention.

As illustrated in FIG. 8, cutting assembly 115 may include a body member 285, an actuating assembly 290, and a cutting member 295. Cutting member 295 may be removably disposable in body member 285. Actuating assembly 290 may operate to move body member 285 and cutting member 295 within cavity 135 of housing assembly 110. For example, cutting assembly 115 may move within housing assembly 110 between a retracted position as illustrated in FIGS. 1 and 2 and an extended position as illustrated in FIGS. 3 and 4. For example, cutting assembly 115 may be moved to the retracted position, the extended position, or any desired position between the retracted position and the extended position.

Returning to FIG. 8, body member 285 may include a blade receiving portion 300 that may be disposed at a front end portion of cutting device 105 (e.g., near aperture 215). Blade receiving portion 300 may include portions 305 and 310 that may be received in portions of cutting member 295. Blade receiving portion 300 may also include a protrusion 315 that may be received in an aperture of cutting member 295 as described for example below. Body member 285 may include any other suitable protrusions, recesses, apertures, and/or any other suitable portions to allow for a removable attachment of cutting member 295 to body member 285. Cutting member 295 may thereby be removably attached to body member 285 by blade receiving portion 300.

Body member 285 may also include a plurality of portions 320 and 325. Portions 320 and 325 may be received by portions of housing assembly 110 to allow for a movement of cutting assembly 115 within cavity 135 of housing assembly 110. For example, portions 320 and 325 may be received in recesses 185 and 190 of second housing member 125. Body member 285, other portions of cutting assembly 115, and/or housing assembly 110 may include any suitable recesses, apertures, cavities, protrusions, and/or any other suitable portions that may interact with each other to provide a desired direction of movement or movement path (e.g., movement track). For example, portions 320 and 325 being received in respective recesses 185 and 190 housing assembly 110 may provide a substantially straight and/or non-rotational movement of cutting assembly 115 within cavity 135 such as a straight movement in which cutting assembly 115 does not rotate. It is also contemplated that a movement path or track of cutting member 115 within housing assembly 110 that is curved, non-linear, and/or rotational may also be provided.

As illustrated in FIG. 8, actuating assembly 290 may include an actuating member 350 and an urging member 360. Actuating member 350 and urging member 360 may be disposed at body member 285.

Actuating member 350 may include a plurality of protrusions 365 such as ridges or other suitable tactile protrusions disposed on a surface 370 of actuating member 350. A user of cutting device 105 may interact with actuating member 350 to move cutting assembly 115 within housing assembly 110. Protrusions 365 may assist a user with maintaining positive contact (e.g., non-slipping contact) with actuating member 350 as the user pushes or pulls at actuating member 350. Actuating member 350 may also include a plurality of protrusions 375 and 380 that may be selectively received by respective recesses 230 on both sides of aperture 220 based on a movement of cutting assembly 115 within cavity 135. Actuating member 350 may also include one or more protrusions 385 that may be received (e.g., slidably received) by one or more apertures 342 of body member 285. For example as described below, protrusions 385 may be movably received in apertures 342.

Urging member 360 may apply an urging force to actuating member 350 that urges actuating member 350 away from body member 285 and toward first housing member 120. Urging member 360 may thereby apply an urging force to actuating member 350 that urges protrusions 375 and 380 against surface portions forming recesses 230. Urging member 360 may be a potential-energy-storing member. Urging member 360 may be any suitable member that may be for example stretched and unstretched and/or compressed and uncompressed. Urging member 360 may be urged or biased between a neutral or unbiased state (e.g., storing substantially no potential energy) and a biased state (e.g., storing potential energy). Urging member 360 may be, for example, a tension member or a compression member. For example, urging member 360 may be a spring having a plurality of coils. Urging member 360 may also be an elastic member or elastic band, a cable, a wire, and/or a member formed from materials having elastic or resilient properties and capable of being stretched and unstretched (e.g., or compressed and uncompressed). Urging member 360 may be formed from any suitable materials for forming a tension member or a compression member (e.g., that can be stretched and unstretched, or compressed and uncompressed) such as metallic material, plastic material, composite material, elastomeric material, natural rubber, and/or synthetic rubber. For example, urging member 360 may be a metallic, plastic, or composite spring. Also for example, urging member 360 may be a rubber band or an elastomeric cable, wire, or cord.

Cutting device 105 may also include an urging member 362 that may be of a generally similar type of urging member as urging member 360 and formed from similar materials as urging member 360. As illustrated in FIGS. 8-10, urging member 362 may include a first end portion 369 that may be attached to a portion 366 of body member 285 and a second end portion 364 that may be attached to a portion 371 of second housing member 125 (e.g., and/or first housing member 120). When actuating member 350 is not being actuated, urging member 362 may urge actuating member 350 to a retracted position as illustrated in FIG. 9 (e.g., urging member 362 may be compressed in at least some exemplary embodiments). When a user applies a force to actuating member 350 that exceeds an urging force of urging member 362, actuating member 350 may be urged to an extended position as illustrated in FIG. 10 (e.g., urging member 362 may be stretched to store potential energy in at least some exemplary embodiments).

Returning to FIG. 8, cutting member 295 may be removably attachable to blade receiving portion 300 of body member 285. Cutting member 295 may include a plurality of recesses 395. One or more recesses 395 may for example receive portions of body member 285 (e.g., portions 305 and/or 310). Cutting member 295 may also include an aperture 400 that may receive protrusion 315 of body member 285. Cutting member 295 may include any other suitable protrusions, recesses, apertures, and/or any other suitable portions to allow for a removable attachment of cutting member 295 to body member 285.

Cutting member 295 may be any suitable blade, cutter, or scraper for cutting or scraping of a material by cutting device 105. For example, cutting member 295 may be formed from a ceramic material that is capable of withstanding extended use before becoming dull or unusable. For example, cutting member 295 may be a ceramic blade or scraper. For example, cutting member 295 may include ceramic materials such as Zirconium Oxide or any other suitable ceramic materials for use in a blade. For example, cutting member 295 may be a ceramic blade that may be a scraper blade formed from Zirconium Oxide. Alternatively for example, cutting member 295 may be a metal blade or a blade formed from any suitable material than can be used for cutting or scraping materials. Cutting member 295 may include rounded tips to reduce the chance of a user being cut unintentionally by cutting member 295.

As illustrated in FIGS. 3, 4, and 8, cutting member 295 may include a portion 405 that may be used for cutting material. Cutting member 295 may be of any suitable shape or configuration for cutting material. Portion 405 may be a relatively narrow portion (e.g., narrower relative the other portions of cutting member 295) of cutting member 295 that may serve to cut material.

As illustrated in FIG. 8, body member 285 may include portions 406 and 407, and second housing member 125 may include portions 408 and 409. It is also contemplated that first housing member 120 may include portions 408 and 409. Portions 406 and 407 may be for example portions that protrude from body member 285. For example, portions 406 and 407 may be tabs or tab portions. Portions 408 and 409 may form recess portions that may be configured to receive portions 406 and 407, respectively. For example, portions 408 and 409 may be slots or slot portions that may receive portions 406 and 407, respectively. For example, when body member 285 (e.g., cutting assembly 115) is moved to an extended position, portion 406 may be moved to be received by portion 408, and portion 407 may be moved to be received by portion 409. Body member 285 may be thereby secured or attached to second housing member 125 when cutting assembly 115 is in the extended position. When cutting device 105 is being used (e.g., when cutting member 295 in the extended position is pressed against or pushed down against a work piece such as a material being scraped), the engagement of portions 406, 407, 408, and 409 may substantially prevent housing members 120 and 125 from separating based on the force or pressure applied to cutting device 105.

As illustrated in FIGS. 1-4, cutting device 105 may include front corner portions 410 and 415. Portions 410 and 415 may be sized (e.g., dimensioned) to allow a user to turn or rotate cutting device 105 during use (e.g., during scraping) so that a side edge of cutting member 295 may scrape near a wall or side edge of an object without portions 410 and 415 bumping into or abutting that side edge. For example, corner portions 410 and 415 may be curved or rounded corner portions. This may for example allow a user to cut or scrape otherwise inaccessible areas.

In at least some exemplary embodiments, the exemplary disclosed cutting device may include a housing (e.g., including housing members 120 and 125), a cutting assembly (e.g., cutting assembly 115) that is movably disposed in the housing, the cutting assembly including a body member (e.g., body member 285), an actuating member (e.g., actuating member 350), and a first urging member (e.g., urging member 360) configured to urge the actuating member away from the body member, from an inner position toward an outer position relative to the body member, by applying a first urging force, and a second urging member (e.g., urging member 362) configured to urge the cutting assembly to retract within the housing by applying a second urging force that urges the actuating member to move from an extended position toward a retracted position relative to the housing. The housing may include at least one recess. The actuating member may include at least one protrusion that is selectively receivable in the at least one recess when the actuating member is in both the extended position relative to the housing and the inner position relative to the body member. The first urging force may be less than the second urging force. The first urging force may be less than half of the second urging force. The first urging force may be in a direction that is substantially perpendicular to a direction of the second urging force. The at least one recess may be formed by a plurality of wall portions, and at least one of the plurality of wall portions may block the at least one protrusion from moving toward the retracted position relative to the housing when the at least one protrusion is received in the at least one recess. When the at least one protrusion is received in the at least one recess, the actuating member may be movable toward the outer position relative to the body member but may not be movable toward the retracted position relative to the housing. The housing may include a first housing member and a second housing member that is removably attachable to the first housing member. The exemplary disclosed cutting device may further include a locking assembly that selectively locks the first housing member to the second housing member. The at least one protrusion may include two protrusions that are selectively receivable, respectively, in the at least one recess that includes two recesses. The exemplary disclosed cutting device may further include a cutting member that is removably attachable to the cutting assembly. The cutting member may include Zirconium Oxide.

In at least some exemplary embodiments, the exemplary disclosed cutting device may include a first housing member (e.g., housing member 120), a second housing member (e.g., housing member 125) that is removably attachable to the first housing member to form a housing, a cutting assembly (e.g., cutting assembly 115) that is movably disposed in the housing, the cutting assembly including a body member (e.g., body member 285), an actuating member (e.g., actuating member 350), and a first spring (e.g., urging member 360) configured to urge the actuating member away from the body member, from an inner position toward an outer position relative to the body member, by applying a first spring force, and a second spring (e.g., urging member 362) configured to urge the cutting assembly to retract within the housing by applying a second spring force that urges the actuating member to move from an extended position toward a retracted position relative to the housing. The housing may include at least one recess. The actuating member may include at least one protrusion that is selectively receivable in the at least one recess when the actuating member is in both the extended position relative to the housing and the inner position relative to the body member. The first spring force may be less than the second spring force and applied in a direction that is substantially perpendicular to a direction of the second spring force. The at least one recess may be formed by a plurality of wall portions, and at least one of the plurality of wall portions may block the at least one protrusion from moving toward the retracted position relative to the housing when the at least one protrusion is received in the at least one recess. When the at least one protrusion is received in the at least one recess, the actuating member may be movable toward the outer position relative to the body member but may not be movable toward the retracted position relative to the housing.

The exemplary disclosed device and method may provide an intuitively simple and safe technique for cutting materials and/or replacing blades of a cutting device such as, for example, a scraper. The exemplary disclosed device and method may be used in any application involving cutting materials such as scraping material. For example, the exemplary cutting device and method may be used in applications such as removing undesired material from a surface, smoothing or levelling a surface, preparing a surface for a desired use or further treatment, and/or any other suitable application for scraping material. The exemplary disclosed device and method may be used in any application for reducing fatigue or discomfort to a user (e.g., to a user's thumb or finger).

Figure 11:
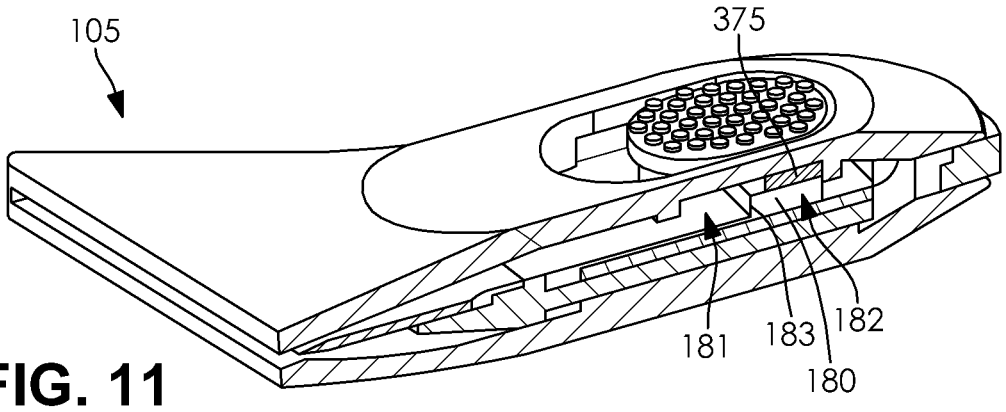
FIG. 11 is a perspective view of an exemplary cutting device in accordance with an embodiment of the present invention.

An exemplary operation of exemplary cutting device 105 will now be described. A user may store, transport, and/or carry cutting device 105 in the retracted position illustrated in FIGS. 1 and 2. Actuating member 350 may be disposed in a rear position (e.g., a "home" position) of aperture 220 in the retracted position. Also in the retracted position, protrusions 375 and 380 may be disposed above and abutting respective surfaces 182 and 177 illustrated in FIG. 8. FIG. 11 illustrates an exemplary retracted position. Urging member 360 may urge or bias against actuating member 350, which may urge protrusions 375 and 380 upward against surfaces of recesses 230. Urging member 362 may be in the compressed position as illustrated in FIG. 9 when actuating member 350 is in the retracted position as illustrated in FIG. 11. For example, unless force is applied (e.g., by a user) to overcome the urging force of urging member 362, urging member 362 may remain in the compressed state and maintain actuating member 350 in the retracted position as illustrated in FIGS. 9 and 11. In the retracted position, portion 405 of cutting member 295 may be retracted in cavity 135 and may not extend through aperture 215.

Figure 12:
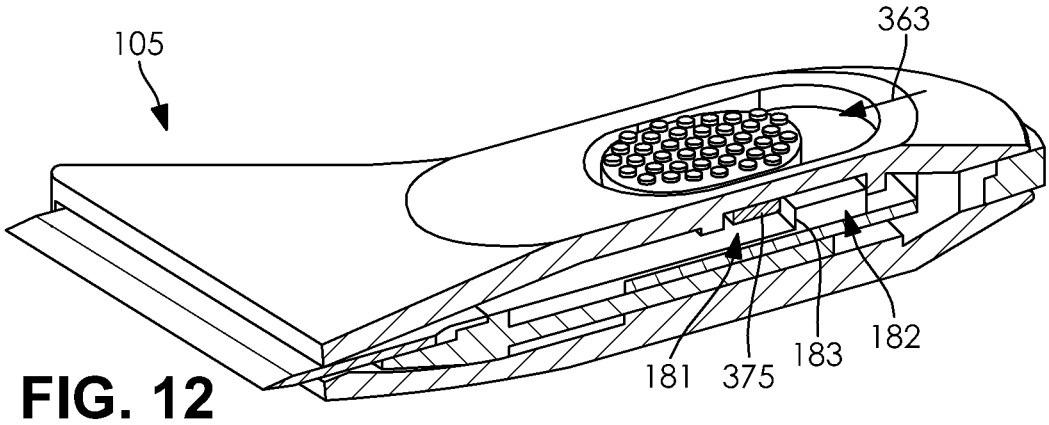
FIG. 12 is a perspective view of an exemplary cutting device in accordance with an embodiment of the present invention.

A user may move cutting device 105 from the retracted state illustrated in FIGS. 1 and 2 to the extended state illustrated in FIGS. 3 and 4. The user may press actuating member 350 toward a front position of aperture 220. As illustrated in FIG. 12, the user may apply a moving force 363 that exceeds the urging force of urging member 362 (e.g., the urging force of urging member 362 may urge actuating member 350 in a direction opposite to moving force 363), thereby moving actuating member 350 toward an extended position and stretching urging member 362 (e.g., alternatively, the user may compress the exemplary urging member from an uncompressed state to a compressed state). The user may thereby move actuating member 350 and urging member 362 to the positions shown in FIGS. 10 and 12. Once actuating member 350 has been moved to the front position of aperture 220 in an extended position (e.g., with a front portion of actuating member 350 abutting against a front wall portion of portion 225), protrusions 375 and 380 may be substantially aligned with recesses 181 and 176, respectively. When the user has pushed actuating member 350 to be in the forward or extended position illustrated in FIG. 12, the user may then push actuating member 350 inward toward an interior of cutting device 105. The user may thereby apply an inward force 361 to actuating member 350 that may overcome the urging force of urging member 360 (e.g., that may oppose inward force 361). Inward force 361 may thereby move actuating member 350 toward an interior of cutting device 105, from the position (e.g., outer position) illustrated in FIG. 12 to the position (e.g., inner position) illustrated in FIG. 13. Protrusions 375 and 380 may thereby be received by respective recesses 181 and 176. When moving actuating member 350 from the outer position illustrated in FIG. 12 to the inner position illustrated in FIG. 13, the user may apply both moving force 363 that stretches (e.g., or alternatively compresses) urging member 362 and inward force 361 that compresses (e.g., or alternatively stretches) urging member 360.

Figure 13:
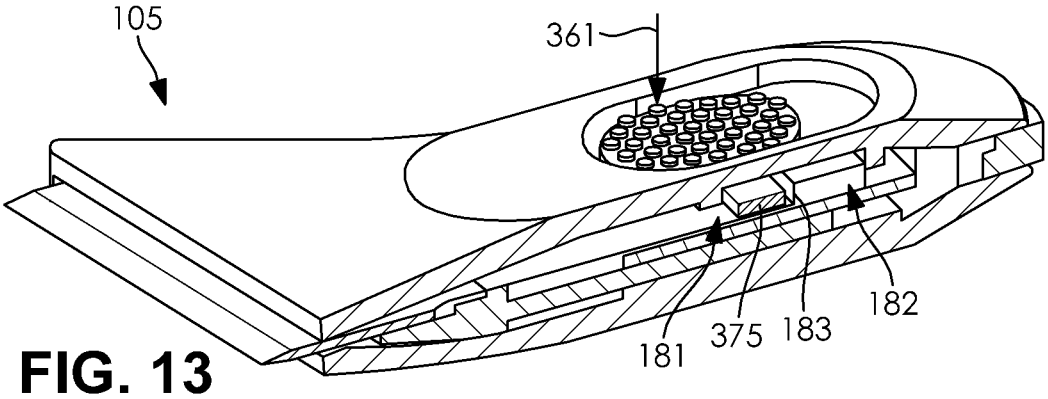
FIG. 13 is a perspective view of an exemplary cutting device in accordance with an embodiment of the present invention.

Inward force 361 suitable to overcome the urging force of urging member 360 may be a relatively small force. For example, the force suitable to move actuating member 350 from the outer position illustrated in FIG. 12 to the inner position illustrated in FIG. 13 may be relatively small. In at least some exemplary embodiments, inward force 361 may be less than (e.g., significantly less than) moving force 363. Inward force 361 may be angled to (e.g., substantially perpendicular to) moving force 363. Although a user applies both moving force 363 and inward force 361 to move actuating member 350 from the outer position illustrated in FIG. 12 to the inner position illustrated in FIG. 13, the user may cease applying moving force 363 once actuating member 350 is in the inner position illustrated in FIG. 13. For example, as long as the user applies inward force 361 when actuating member 350 is in the inner position illustrated in FIG. 13, a wall portion 183 of recess 181 and a wall portion 178 of recess 176 may hold respective protrusions 375 and 380 in place and thereby oppose the urging force of urging member 362. Accordingly, if the user applies inward force 361 to maintain protrusions 375 and 380 in respective recesses 181 and 176, cutting device 105 may remain in the extended position. Also for example, any suitable portions (e.g., wall portions) of portions 180 and/or 175 and/or any other suitable portions of cutting device 105 (e.g., portions of cutting assembly 115 or other portions of housing members 120 and 125) may hold respective protrusions 375 and 380 in place. As inward force 361 (e.g., force suitable to overcome the urging force of urging member 360) may be less than (e.g., three-quarters of, half of, a quarter of, or any desired fraction of) moving force 363 (e.g., force suitable to overcome the urging force of urging member 362), the user may maintain actuating member 350 in an extended position by using relatively less force than was used to push cutting assembly 115 from the retracted position to the extended position. Urging members 360 and 362 may be sized and/or formed from material to provide a desired spring constant (e.g., that may determine the amount of urging force for stretching or compressing the urging member). For example, the urging force of urging member 360 may be less than (e.g., three-quarters of, half of, a quarter of, or any desired fraction of) the urging force of urging member 362. As less force may be used to maintain cutting assembly 115 in an extended position once the extended position is reached, the user may experience less discomfort and fatigue when using cutting device 105 to cut (e.g., a user's thumb or finger won't become tired or fatigued because relatively little force is used to maintain cutting assembly 115 in the extended position during use). Respective protrusions 375 and 380 and walls of recesses 181 and 176 may thereby operate together to allow the user to avoid discomfort by allowing the user to use a relatively small amount of force to apply inward force 361 to keep cutting assembly 115 maintained in the extended position (e.g., "locked" in position against the urging force of urging member 362 attempting to move actuating member 350 backwards to the retracted position) without applying moving force 363. For example, FIG. 13 illustrates an exemplary extended position that may be a forward, extended, and locked position.

At any desired time, a user may move cutting device 105 from the extended state illustrated in FIGS. 3 and 4 back to the retracted state illustrated in FIGS. 1 and 2 by following steps similar to those described above. For example, the user may release actuating member 350 (e.g., stop applying force to protrusions 365 and/or surface 370). For example, when actuating member 350 in in the position shown in FIG. 13, the user may cease applying inward force 361. Once the user stops applying force to actuating member 350, the urging force of spring 360 may move actuating member 350 from the inner position illustrated in FIG. 13 to the outer position illustrated in FIG. 12. Once actuating member 350 moves to the outer position illustrated in FIG. 12 so that protrusions 375 and 380 have been removed from respective recesses 181 and 176, wall portion 183 of recess 181 and wall portion 178 of recess 176 may no longer oppose the urging force of urging member 362. The urging force of urging member 362 may then move actuating member 350 from the extended position illustrated in FIG. 12 to the retracted position illustrated in FIG. 11, thereby moving cutting assembly 115 to the retracted position. Accordingly, cutting device 105 may automatically return cutting assembly 115 from an extended position to a retracted position when a user ceases applying force (e.g., inward force 361) to actuating member 350 that may maintain cutting assembly 115 in the extended position. Actuating assembly 290 may thereby be maintained at a rear position of aperture 220 by the urging force of urging member 362, which may maintain cutting device 105 again in the retracted position as described for example above.

In at least some exemplary embodiments, actuating member 350 may be in a retracted, outer position as illustrated in FIG. 11. Actuating member 350 may be in an extended, outer position as illustrated in FIG. 12. Actuating member 350 may be in an extended, inner position as illustrated in FIG. 13.

The user may unlock cutting device 105 by moving locking assembly 130 from the exemplary locked position (e.g., at locked indicator 275) to the exemplary unlocked position (e.g., at unlocked indicator 280) by pushing (e.g., or pulling or toggling) protrusion 265. When cutting device 105 is unlocked, a user may detach first housing member 120 from second housing member 125 as illustrated in FIG. 8. As described for example above, cutting assembly 115 may be retained on second housing member 125 (e.g., or first housing member 120) when a user detaches first housing member 120 from second housing member 125.

When housing members 120 and 125 are detached from each other, a user may replace cutting member 295 as desired. For example, the user may detach an existing cutting member 295 from cutting assembly 115 so that protrusion 315 is removed from aperture 400 and portions 305 and 310 are removed from recesses 395. The user may then attach a new cutting member 295 to cutting assembly 115 by inserting protrusion 315 into aperture 400 and inserting portions 305 and 310 into recesses 395. Housing members 120 and 125 may then be reattached to each other and locked to each other by moving locking assembly 130 from the exemplary unlocked position (e.g., at unlocked indicator 280) to the exemplary locked position (e.g., at locked indicator 275) by pushing (e.g., or pulling or toggling) protrusion 265.

In at least some exemplary embodiments, the exemplary disclosed method may include movably disposing a cutting assembly (e.g., cutting assembly 115) in a housing (e.g., including housing members 120 and 125), the cutting assembly including an actuating member (e.g., actuating member 350) and a body member (e.g., body member 285), urging the actuating member away from the body member, from an inner position toward an outer position relative to the body member, by applying a first urging force, urging the cutting assembly to retract within the housing by applying a second urging force that urges the actuating member to move from an extended position toward a retracted position relative to the housing, and applying a moving force that is greater than the second urging force to move the actuating member to the extended position relative to the housing. When the actuating member is in the extended position relative to the housing, the exemplary disclosed method may also include applying an inward force that is greater than the first urging force to move the actuating member to the inner position relative to the body member. When the actuating member is in both the extended position relative to the housing and the inner position relative to the body member, the exemplary disclosed method may also include removing the moving force while maintaining the inward force and using a portion of the housing to block movement of the actuating member toward the retracted position relative to the housing. The exemplary disclosed method may further include, when the actuating member is in both the extended position relative to the housing and the inner position relative to the body member, removing both the moving force and the inward force so that the actuating member moves to the outer position relative to the body member and to the retracted position relative to the housing. The first urging force may be less than the second urging force. The first urging force may be less than one-half of the second urging force. The actuating member may be maintained in both the extended position relative to the housing and the inner position relative to the body member by removing the moving force and maintaining the inward force that is both greater than the first urging force and applied in a direction that is substantially perpendicular to the second urging force. The actuating member may move to the retracted position relative to the housing and the outer position relative to the body member when both of the moving force and the inward force are removed.

The exemplary disclosed cutting device and method may provide an intuitively simple device and technique for using a cutting device and for safely and easily replacing blades of the cutting device for cutting or scraping a surface of a material. The exemplary disclosed device and method may provide a quick and efficient way to change between a mode in which a blade such as a scraping blade is exposed and a mode in which the blade is safely covered or retracted. The exemplary disclosed cutting device and method may allow a user to maintain a cutting device in an extended position by applying a small force such as a small inward force, which may reduce the amount of force involved with using the cutting device and provide a comfortable user experience. For example, a user's thumb or fingers may not experience fatigue or discomfort based on using the cutting device.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising: a housing; a cutting assembly that is movably disposed in the housing, the cutting assembly including a body member, an actuating member, and a first urging member that is configured to urge the actuating member away from the body member, from an inner position toward an outer position relative to the body member, by applying a first urging force; and a second urging member that is configured to urge the cutting assembly to retract within the housing by applying a second urging force that urges the actuating member to move from an extended position toward a retracted position relative to the housing; wherein the housing includes at least one recess; wherein the actuating member includes at least one protrusion that is selectively receivable in the at least one recess when the actuating member is in both the extended position relative to the housing and the inner position relative to the body member; wherein the first urging member is disposed between the actuating member and the body member, and wherein the first urging force is less than the second urging force.

2. The cutting device of claim 1, wherein the first urging force is less than half of the second urging force.

3. The cutting device of claim 1, wherein the first urging force is in a direction that is substantially perpendicular to a direction of the second urging force.

4. The cutting device of claim 1, wherein the at least one recess is formed by a plurality of wall portions, and at least one of the plurality of wall portions blocks the at least one protrusion from moving toward the retracted position relative to the housing when the at least one protrusion is received in the at least one recess.

5. The cutting device of claim 4, wherein:

when the at least one protrusion is received in the at least one recess, the actuating member is movable toward the outer position relative to the body member but is not movable toward the retracted position relative to the housing; and the at least one protrusion extends from the actuating member in a direction perpendicular to both a first urging direction of the first urging force and a second urging direction of the second urging force.

6. The cutting device of claim 1, wherein the housing includes a first housing member and a second housing member that is removably attachable to the first housing member.

7. The cutting device of claim 6, further comprising a locking assembly that selectively locks the first housing member to the second housing member.

8. The cutting device of claim 1, wherein the at least one protrusion includes two protrusions that are selectively receivable, respectively, in the at least one recess that includes two recesses.

9. The cutting device of claim 1, further comprising a cutting member including Zirconium Oxide that is removably attachable to the cutting assembly.

10. The cutting device of claim 1, wherein the first urging force is less than three-quarters of the second urging force.

11. A method, comprising: movably disposing a cutting assembly in a housing, the cutting assembly including an actuating member and a body member; urging the actuating member away from the body member via an urging member, from an inner position toward an outer position relative to the body member, by applying a first urging force via the urging member; urging the cutting assembly to retract within the housing by applying a second urging force that urges the actuating member to move from an extended position toward a retracted position relative to the housing; applying a moving force that is greater than the second urging force to move the actuating member to the extended position relative to the housing; when the actuating member is in the extended position relative to the housing, applying an inward force that is greater than the first urging force to move the actuating member to the inner position relative to the body member; and when the actuating member is in both the extended position relative to the housing and the inner position relative to the body member, removing the moving force while maintaining the inward force and using a portion of the housing to block movement of the actuating member toward the retracted position relative to the housing; separating the actuating member from the body member using the urging member, and wherein the first urging force is less than the second urging force.

12. The method of claim 11, further comprising, when the actuating member is in both the extended position relative to the housing and the inner position relative to the body member, removing both the moving force and the inward force so that the actuating member moves to the outer position relative to the body member and to the retracted position relative to the housing.

13. The method of claim 11, wherein the first urging force is less than one-half of the second urging force.

14. The method of claim 11, wherein the actuating member is maintained in both the extended position relative to the housing and the inner position relative to the body member by removing the moving force and maintaining the inward force that is both greater than the first urging force and applied in a direction that is substantially perpendicular to the second urging force.

15. The method of claim 11, wherein the actuating member moves to the retracted position relative to the housing and the outer position relative to the body member when both of the moving force and the inward force are removed.

* * * * *